US005703307A

United States Patent [19]

Ikeya

[11] Patent Number: 5,703,307

[45] Date of Patent: Dec. 30, 1997

[54] TONE GENERATING APPARATUS WITH FM SOUND SOURCE AND PCM SOUND SOURCE

[75] Inventor: Akira Ikeya, Hamamatsu, Japan

[73] Assignee: Yamaha Corporation, Japan

[21] Appl. No.: 563,182

[22] Filed: Nov. 27, 1995

[30] Foreign Application Priority Data

Nov. 29, 1994 [JP] Japan ..... 6-294782

[51] Int. Cl.[6] ..... G10H 7/00

[52] U.S. Cl. ..... 84/603; 84/622; 84/659

[58] Field of Search ..... 84/603–607, 622–625, 84/659–661

[56] References Cited

U.S. PATENT DOCUMENTS 5,094,136 3/1992 Kudo et al. ..... 84/603

*Primary Examiner*—William M. Shoop, Jr.
*Assistant Examiner*—Marlon Fletcher
*Attorney, Agent, or Firm*—Graham & James LLP

[57] ABSTRACT

A tone generating apparatus for connection to a control device has a tone signal-generating block having a plurality of tone signal-forming circuits that form tone signals in respective tone signal-forming manners. A determining block determines to which of the plurality of tone signal-forming circuits control data delivered from the control device is to be supplied. A control data supply block supplies the control data to a corresponding one of the plurality of tone signal-forming circuits of the tone signal-generating block, depending upon a result of the determination by the determining block.

8 Claims, 6 Drawing Sheets

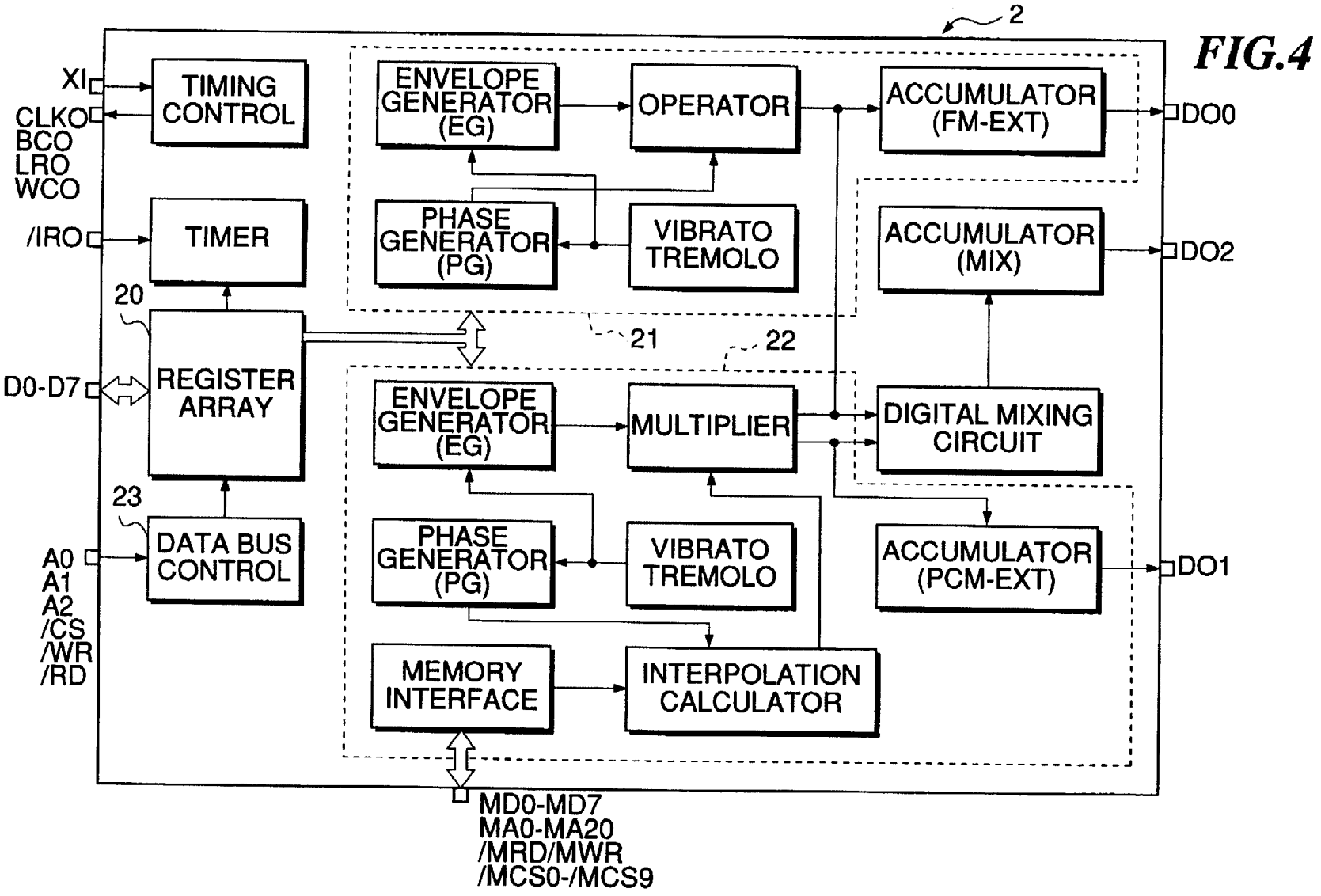
FIG.4
2
DO0
DO2
DO1
ACCUMULATOR (FM-EXT)
ACCUMULATOR (MIX)
DIGITAL MIXING CIRCUIT
ACCUMULATOR (PCM-EXT)
OPERATOR
VIBRATO TREMOLO
MULTIPLIER
VIBRATO TREMOLO
INTERPOLATION CALCULATOR
21
22
ENVELOPE GENERATOR (EG)
PHASE GENERATOR (PG)
ENVELOPE GENERATOR (EG)
PHASE GENERATOR (PG)
MEMORY INTERFACE
MD0-MD7
MA0-MA20
/MRD/MWR
/MCS0-/MCS9
TIMING CONTROL
TIMER
REGISTER ARRAY
DATA BUS CONTROL
20
23
XI
CLKO
BCO
LRO
WCO
/IRO
D0-D7
A0
A1
A2
/CS
/WR
/RD T1:GOES "H" WHEN FM IS ADDRESSED(AS)
T2:GOES "H" WHEN COMMAND REGISTER OF MPU-401 IS DESIGNATED(AI)
T3:GOES "H" WHEN DATA 3FH IS RECEIVED

TONE GENERATING APPARATUS WITH FM SOUND SOURCE AND PCM SOUND SOURCE

BACKGROUND OF THE INVENTION

1. Field of the Invention

This invention relates to a tone generating apparatus which is equipped with both an FM sound source block and a PCM sound source block and permits effective utilization of the two sound source blocks.

2. Prior Art

Recently, more and more software products (especially for video games) are on the market, which require the tone-generating function of personal computers (hereinafter simply referred to as "PC(s)"), and accordingly, more PCs tend to incorporate sound boards. Most sound boards use frequency modulation (FM) sound sources or pulse-code modulation (PCM) sound sources. The FM sound source is based on an FM method of synthesizing tones by frequency-modulating arithmetic computation according to a predetermined algorithm, while the PCM sound source is based on a PCM method of synthesizing tones by reading waveform data stored in a waveform memory in a continuous and/or repetitive manner. The different methods require application of different parameters necessary for driving the sound sources in respective specific manners.

To drive the FM sound source, conventional PCs employ a method of a CPU thereof directly accessing an LSI of the FM sound source via a bus directly connecting between the LSI and the CPU, to thereby control the operation of the LSI. The aforementioned software products for games or the like employ this method to control the FM sound source. To drive the PCM sound source, an LSI 54 forming the PCM sound source 53 is connected to a PC 50, as shown in FIG. 1, via its own CPU 52 and an interface 51 for sending and receiving MIDI data. As the interface, there has been employed an MPU-401 UART mode interface as a standard model, which was originally incorporated as a device implementing part of a function of an MPU-401 interface card (manufactured by Roland Corporation).

A sound board which is capable of generating tones based on both the FM method and the PCM method is also in actual use. This type of sound board is called a standard sound card and constructed such that the FM sound source and the MPU-401 UART mode interface are arranged in parallel with each other, as shown in FIG. 2. More specifically, an FM sound source LSI 62 within a sound card 61 is directly connected to a bus of a PC 60, and an MPU-401 UART mode interface 63, which is also directly connected to the bus, is connected to a CPU 65 within a sound source block 64, which in turn is connected to a PCM sound source LSI 66 within the sound source block 64. Data input to the MPU-401 UART mode interface 63 is decoded and converted by the CPU 65 and then supplied to the PCM sound source LSI 66. The sound source block 64 constituted by the CPU 65 and the PCM sound source LSI 66 can be formed in one piece with the standard sound card 61 or alternatively connected thereto in a separate piece via a MIDI cable. The illustrated arrangement enables the PC 60 to drive each of the FM and PCM sound sources independently of each other by access using respective different addresses.

To enhance the tone-generating capability of the tone generator and reduce the size of the sound board, an LSI incorporating both an FM sound source block and a PCM sound source block has been developed e.g. as an LSI developed and named YMF278B by the present assignee. This LSI has compatibility with a conventional LSI of the FM sound board (e.g. an LSI developed and named YMF262 by the present assignee) in respect of registers used therein, which enables a conventional sound board system to incorporate and operate the LSI as it is, as the FM sound source LSI 62.

In such a conventional sound board system incorporating the LSI, however, the FM sound source block alone is made effective so that the PCM sound source block is wastefully incorporated. Further, much labor and time are required to prepare software products to control the new LSI. Therefore, there is a demand for a tone generator with this sound source LSI to drive the same by the use of software products already in actual use. That is, it is essential in the market of PCs that new products have compatibility with conventional software products, i.e. a backward compatibility, and hence it is of critical importance that the new LSI is made compatible with conventional software for driving the FM sound source and one for driving the PCM sound source.

SUMMARY OF THE INVENTION

It is an object of the invention to provide a tone generating apparatus which employs a sound source LSI having both an FM sound source block and a PCM sound source block, and is capable of permitting conventional FM sound software and PCM sound software to drive the sound source LSI.

To attain the above object, according to the invention, there is provided a tone generating apparatus for connection to a control device, comprising:

- a tone signal-generating block having a plurality of tone signal-forming circuits that form tone signals in respective tone signal-forming manners;
- a determining block that determines to which of the plurality of tone signal-forming circuits control data delivered from the control device is to be supplied; and
- a control data supply block that supplies the control data to a corresponding one of the plurality of tone signal-forming circuits of the tone signal-generating block, depending upon a result of the determination by the determining block.

The tone generating apparatus according to the invention has a plurality of signal-forming circuits (i.e. sound sources) and is capable of forming tone signals in respective tone signal-forming manners. The control device delivers different kinds of control data each suitable for a corresponding one of the tone signal-forming circuits. The determining block determines to which of the tone signal-forming circuits the control data delivered from the control device is to be supplied, and the control data supply block supplies the control data to a corresponding one of the tone signal-forming circuits of the tone signal-generating block. Therefore, the control device is only required to send control data to the tone generating apparatus in a conventional manner. Upon receiving the control data, the tone generating apparatus discriminates between the different kinds of control data and selectively supplies the control data to the corresponding one of the tone signal-forming circuits.

Preferably, the tone generating apparatus includes a conversion/control block that converts the control data delivered from the control device to converted control data, and the control data supply block supplies the control data delivered from the control device or the converted control data to the corresponding one of the plurality of tone signal-forming circuits of the tone signal-generating block.

According to this preferred form, the tone generating apparatus has a conversion/control block which converts the control data to a form suitable for a corresponding one of the tone signal-forming circuits. That is, the tone generating apparatus is capable of converting the control data to a suitable form and selectively supplying one of the control data from the control device and the converted control data from the conversion/control block to a corresponding one of the tone signal-forming circuits. Therefore, the control device is only required to send the control data to the tone generating apparatus in a conventional manner, which reduces the burden on the control device. Further, software conventionally used for controlling the sound sources can be applied as it is.

More preferably, the control data supply block includes a changeover block that selectively supplies the control data delivered from the control device or the converted control data delivered from the conversion/control block to the tone signal-generating block, depending upon a result of the determination by the determining block.

Further preferably, the determining block delivers a reset signal to the conversion/control block when the determining block determines that the control data delivered from the control device is to be supplied to a predetermined one of the plurality of tone signal-forming circuits, which operates based on the converted control data delivered from the conversion/control block, and the conversion/control block causes changeover block to select the converted control data from the conversion/control block and supply the converted control data to the tone signal-forming block, in response to the reset signal from the determining block.

Further preferably, the determining block receives a signal from the control device, and the determining block delivers an interrupt signal to the conversion/control block when the determining block determines that the signal from the control device designates an address of a predetermined one of the plurality of tone signal-forming circuits, the conversion/control block causing the changeover block to select the control data from the control device and supply the control data to the tone signal-forming block, in response to the interrupt signal from the determining block.

Further preferably, the tone generating apparatus includes an interface block arranged between the control device and the conversion/control block, and the determining block receives a signal from the control device. The determining block determines whether the signal from the control device designates an address of the interface block or the address of the predetermined one of the plurality of tone signal-forming circuits, the determining block causing the changeover block to select the control data from the control device or the converted control data from the conversion/control block, depending upon a result of the last mentioned determination by the determining block.

In a preferred embodiment of the invention, there is provided a tone generating apparatus for connection to a bus of a personal computer, the tone generating apparatus being supplied with control data via the bus from the personal computer to generate a tone signal.

The tone generating apparatus according to the preferred embodiment is characterized by comprising:

- a sound source LSI having an FM sound source block and a PCM sound source block;
- an interface that receives control data for controlling the PCM sound source block from the bus;
- a CPU connected to the interface for decoding the control data input via the interface;
- a selector that selectively connects the sound source LSI to one of the bus and the CPU; and
- registers corresponding respectively to the FM sound source and the PCM sound source of the sound source LSI;
- a changeover control block that operates under control of the CPU for causing the selector to connect the sound source LSI to the bus when one of the registers corresponding to the FM sound source block is accessed through the bus by the personal computer, and for causing the selector to connect the sound source LSI to the CPU when the interface is accessed through the bus by the personal computer.

The tone generating apparatus according to the preferred embodiment is formed, e.g. as a sound board inserted into a slot for an expansion bus of a personal computer. The tone generating apparatus incorporates a sound source LSI having an FM sound source block and a PCM sound source block. When the personal computer (PC) accesses a register corresponding to the FM sound source to drive the FM sound source block, the changeover control block causes the selector to connect the sound source LSI to the bus of the PC. On the other hand, when the PC accesses a register corresponding to the PCM sound source to drive the FM sound source block, the changeover control block causes the selector to connect the sound source LSI to the bus of the PC. Conventional software can be used, according to which the PC directly accesses the LSI of the FM sound source to drive the same. Also, conventional software can be used, according to which the PC sends control data to the interface to drive the PCM sound source. The tone generating apparatus according to the preferred embodiment enables the PC to access and drive the drive the tone generating apparatus to cause the same to generate tone signals by the use of such conventional software. Therefore, the present tone generating apparatus enables the new type of sound source LSI having multiple functions to fully achieve its performance while preserving compatibility with conventional software.

The above and other objects, features, and advantages of the invention will become more apparent from the following detailed description taken in conjunction with the accompanying drawings.

BRIEF DESCRIPTION OF THE DRAWINGS

FIG. 4 is a block diagram showing the interior arrangement of a sound source LSI incorporated in the FIG. 3 sound board;

DETAILED DESCRIPTION

The invention will now be described in detail with reference to drawings showing an embodiment thereof.

Figure 1:
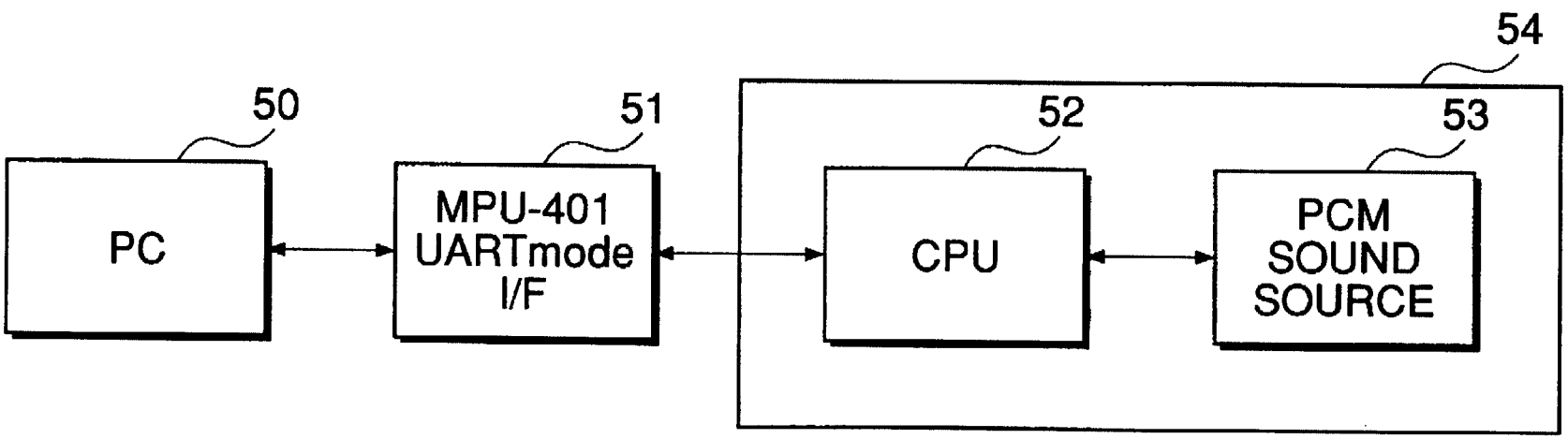
FIG.1 PRIOR ART
FIG. 1 is a diagram showing a manner of connection of a conventional sound source LSI to a PC.
Figure 2:
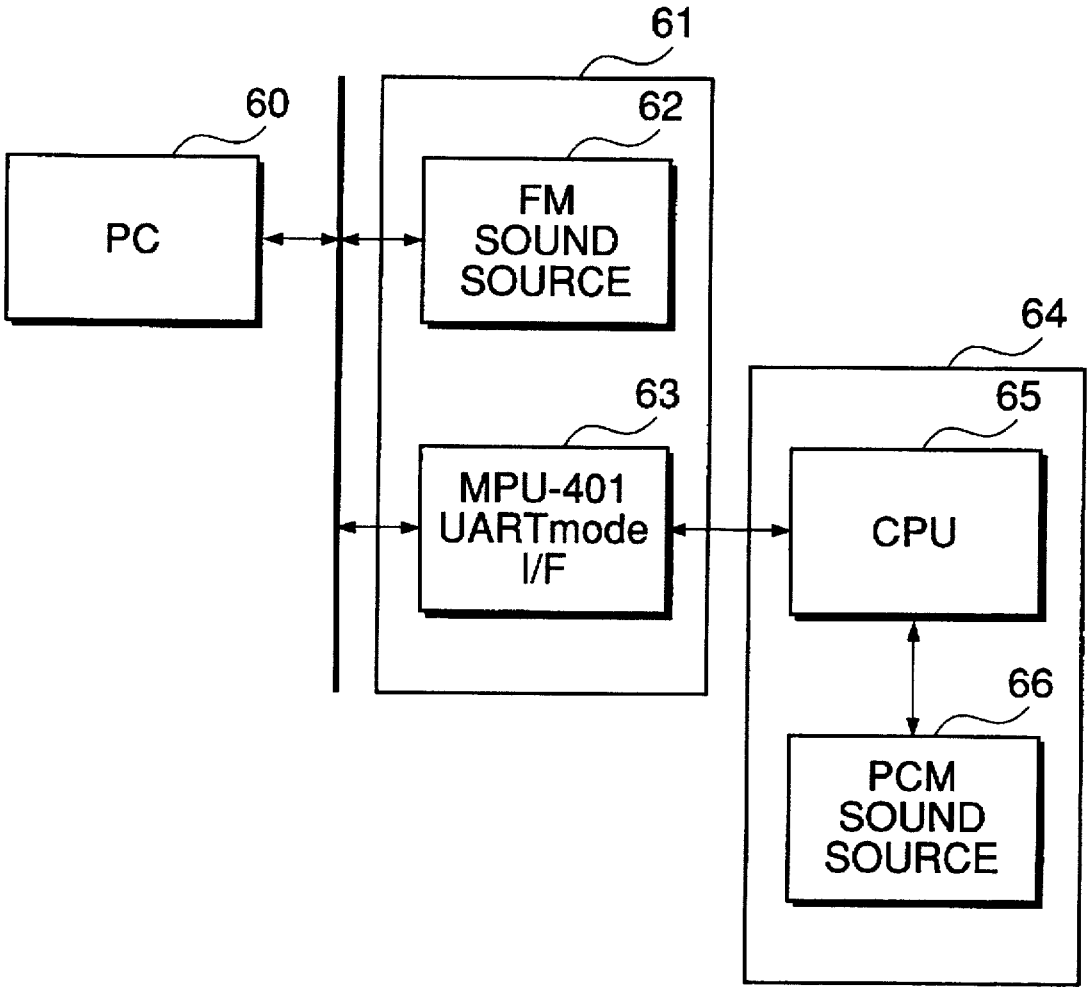
FIG.2 PRIOR ART
FIG. 2 is a diagram showing a conventional manner of connecting a sound source LSI used in the present invention to a PC.
Figure 3:
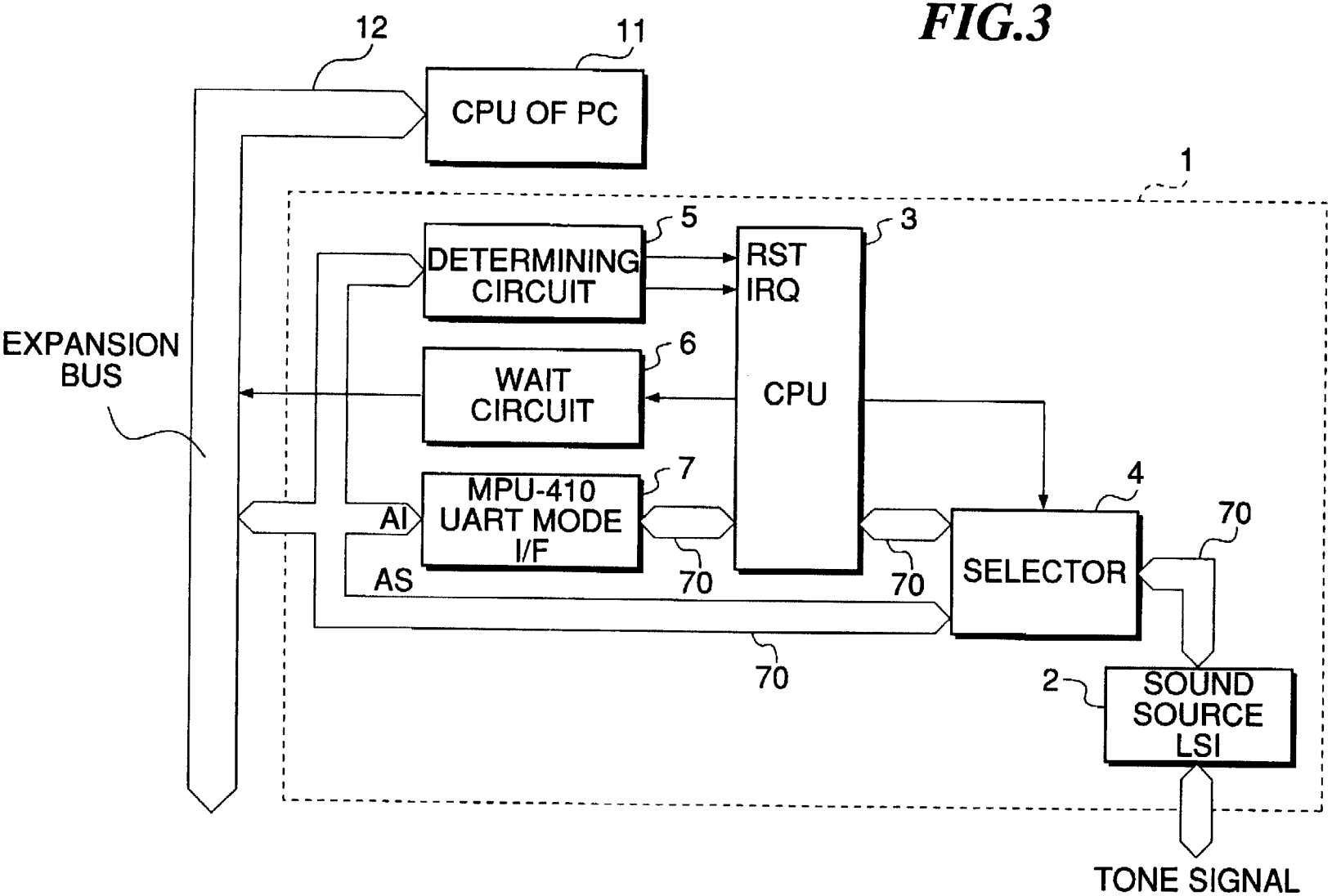
FIG. 3 is a block diagram showing the interior arrangement of a sound board as a tone generating apparatus according to an embodiment of the invention.

Referring first to FIG. 3, there is the interior arrangement of a sound board as a tone generating apparatus according to an embodiment of the invention. In the figure, reference numeral 1 designates a sound board 1 which is inserted into a slot for an expansion bus 12 of a PC and generates tone signals in response to tone generator control data received from a CPU 11 of the PC (hereinafter referred to as "the PC 11"). Connected to the expansion bus 12 of the PC, which includes control signal lines, are a determining circuit 5, a WAIT circuit (WAIT signal register) 6, an MPU-401 UART mode interface (serial interface) 7, and a selector 4. The MPU-401 UART mode interface 7 has an address AI assigned thereto, while the selector 4 has an address AS assigned thereto. The PC 11 accesses an FM sound source block 21 (see FIG. 4) within a sound source LSI 2 by the address AS. The MPU-401 UART mode interface 7 provides interface between the PC 11 and the sound board 1 for transmitting and receiving MIDI data to and from the PCll. The determining circuit 5, the WAIT circuit 6 and the MPU-401 UART mode interface 7 are connected to a CPU 3 for controlling the sound source LSI 2 (hereinafter simply referred to as "the cpu 3").

The WAIT circuit 6 is controlled by the CPU 3. When the CPU 3 is to cause the PC 11 to wait, it delivers a WAIT signal to the WAIT circuit 6, which in turn transmits the WAIT signal via the expansion bus 12 to the PC 11. The selector 4 has output terminals thereof connected via a data bus 70 to data bus terminals D0 to D7, address terminals A0 to A2, chip-selecting signal terminals (/CS: "/" represents a sign of a negative logic), a write enable signal terminal (/WR), and a read enable signal terminal (/RD) of the sound source LSI 2 (see FIG. 4). The CPU 3 supplies a changeover signal to the selector 4 to cause the same to select connection either to the PC 11 or to the CPU 3.

Now, description will be made of the interior arrangement of the sound source LSI 2 with reference to FIG. 4. The sound source LSI 2 incorporates the FM sound source block 21 and the PCM sound source block 22 as mentioned above. Control data for controlling operations of these sound source blocks are input to a register array 20. The register array 20 collectively stores the control data therein by which operations of component parts of the sound source blocks are controlled. An address input to the register array 20 prior to inputting of a specific control data designates a register (write register) of the register array 20 into which the specific control data should be written. More specifically, an address specifying a write register within the register array 20 is first input to the register array 20 via the data bus 70, and then after the lapse of a waiting time of several tens of clocks, control data is input thereto and stored in the write register. In other words, a register address specifying a location in the register array 20 within the sound source LSI 2 is input from the PC 11 or the CPU 3 via the data bus 70, i.e. as data.

Inputting and outputting of data to and from the register array 20 are controlled by a data bus controller 23 to which are input control signals, i.e. the chip-selecting signal/CS, the write enable signal WR, the read enable signal/RD, and the control signals A0 to A2. These control signals are supplied to the data bus controller 23 from the PC 11 via the selector 4, or from the CPU 3 via the selector 4.

The determining circuit 5 determines whether the PC 11 is to access the FM sound source 21 or access the PCM sound source 22, and depending upon the determination result, it delivers a reset signal or an interrupt signal to the CPU 3. More specifically, the determining circuit 5 monitors addresses and data input from the expansion bus 12, to detect access by the PC 11 to the FM sound source block 21 of the sound source LSI 2 or access by the same to the MPU-40 UART mode interface 7 when a predetermined address (AS or AI) or predetermined data is input thereto.

Figure 5:
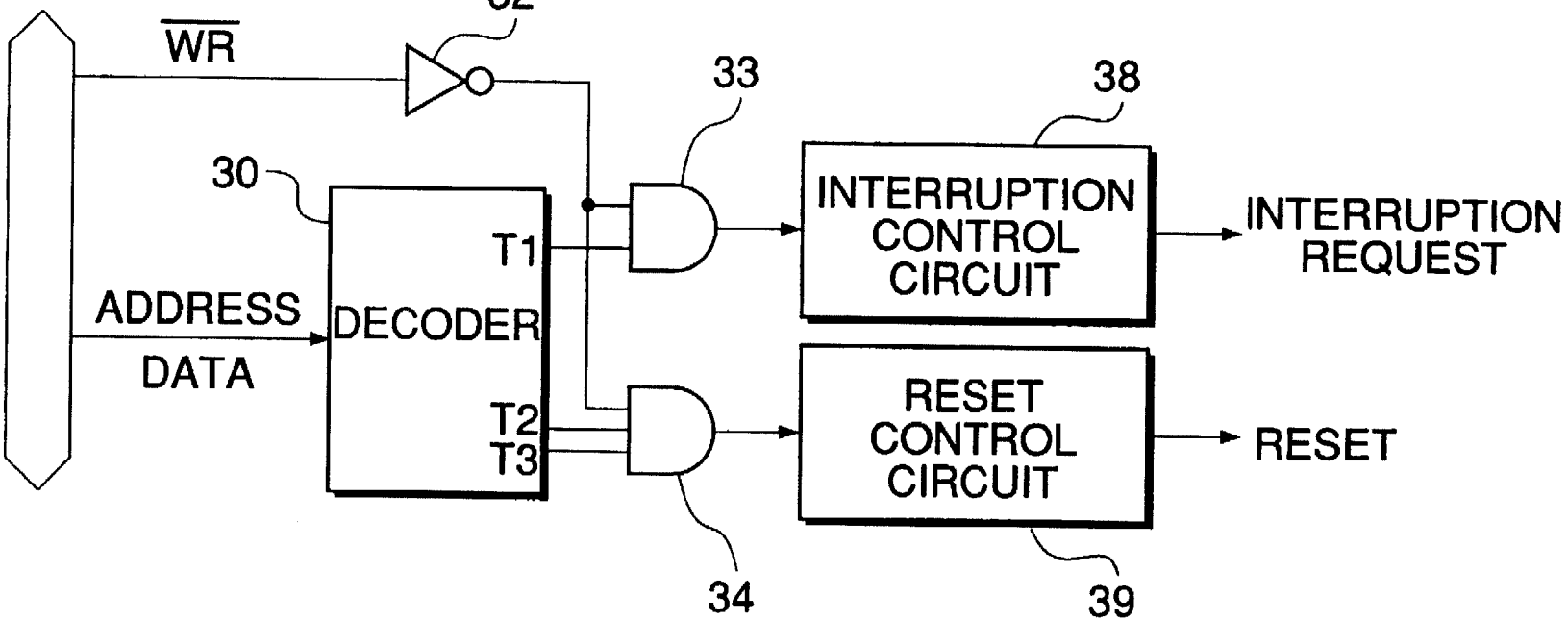
FIG. 5 is a block diagram showing the circuit configuration of a determining circuit incorporated in the FIG. 3 sound board.

FIG. 5 shows, by way of example, the circuit configuration of the determining circuit 5. The determining circuit 5 has a decoder 30 connected to the expansion bus 12 for decoding addresses and data received therefrom, and an inverter 32 connected to a write enable signal (/WR) line. The decoder 30 delivers an "H" signal through an output terminal T1 thereof when it receives the address AS indicative of access to the FM sound source block within the sound source LSI 2 from the expansion bus 12, and an "H" signal through an output terminal T2 thereof when it receives the address AI specifying a command register, not shown, of the MPU-401 UART mode interface 7, from the expansion bus 12. Further, the decoder 30 delivers an "H" signal through an output terminal T3 thereof when it receives data 3FH from the expansion bus 12. The data 3FH, which is first delivered by software for driving the PCM sound source, serves as a command for setting the MPU-401 UART mode of the sound board 1. That is, the data 3FH is start data which is first input to the sound board when the PCM sound source is to be accessed.

The determining circuit 5 has two AND circuits 33, 34 arranged at an output side of the decoder 30. These AND circuits 33, 34 are supplied with the write enable signal/WR via the inverter 32. The AND circuit 33 is also supplied with a signal from the output terminal T1 of the decoder 30. Therefore, the AND circuit 33 delivers an "H" signal when the PC 11 is to write data into an FM sound register block, not shown, of the register array 20 of the sound source LSI 2 of the sound board. In short, this "H" signal permits the PC 11 to access the FM sound source block 21. An output from the AND circuit 33 is input to an interruption control circuit 38. The interruption control circuit 38 delivers an interrupt signal to the CPU 3 when the PC 11 has accessed the FM sound register block of the register array 20 of the sound source LSI 2, which causes the CPU 3 to carry out a predetermined operation for causing the selector 4 to be switched to connection to the PC 11, whereby the PC 11 is permitted to directly access the FM sound register block of the register array 20 of the sound source LSI 2.

Further, the AND circuit 34 is supplied with a signal from the output terminal T2 of the decoder 30 and a signal from the output terminal T3 of the same. Therefore, the AND circuit 34 delivers an "H" signal when the PC 11 is to write the data 3FH into the command register of the MPU-401 UART mode interface 7. That is, the "H" signal from the AND circuit 34 sets the sound card 1 into the MPU-401 UART interface mode. In other words, this signal indicates that software for driving the PCM sound source has been started on the PC 11. The "H" signal from the AND circuit 34 is supplied to a reset control circuit 39 as a reset signal. The reset control circuit 39 then delivers an "H" signal to the CPU 3 to reset the same, whereby the CPU 3 operates to cause the selector 4 to be switched to connection to the CPU 3.

Figure 6B:
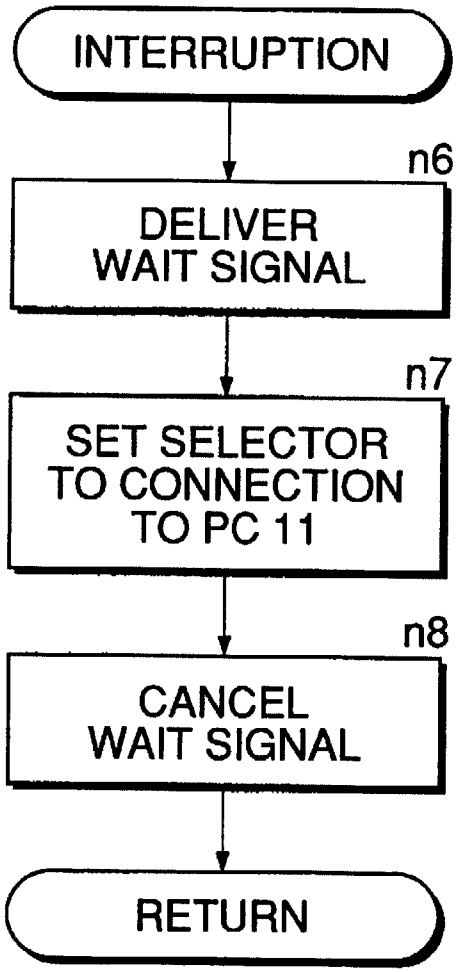
FIGS. 6A and 6B are flowcharts showing routines carried out by a CPU incorporated in the FIG. 3 sound board.
Figure 6A:
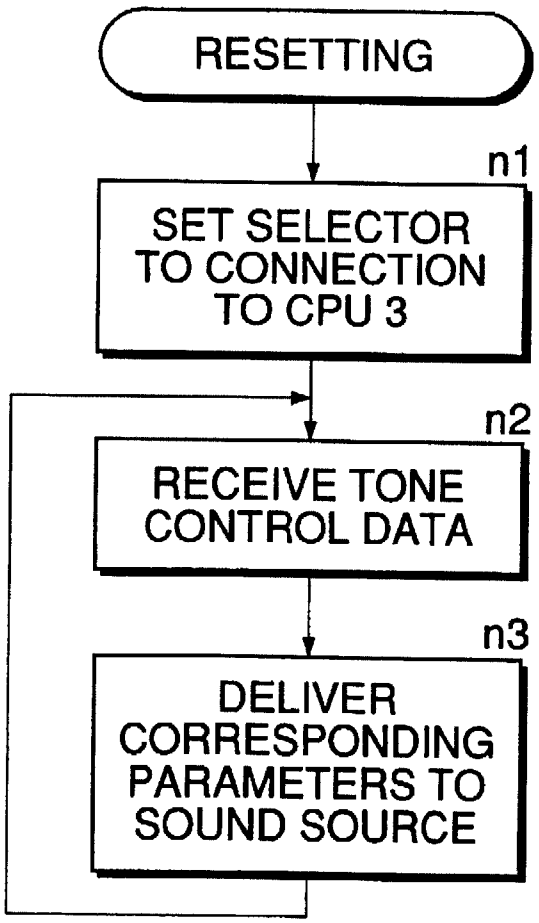

FIGS. 6A and 6B show program routines executed by the CPU 3. FIG. 6A shows a routine executed when the CPU 3 is supplied with the reset signal from the determining circuit 5. Upon receiving the reset signal from the reset control circuit 39 of the determining circuit 5, the CPU 3 executes the following operations: At a step n1, the selector 4 is switched to connection to the CPU 3, thereby enabling the CPU 3 to access the sound source LSI 2. Thereafter, control data are received from the PC 11 at a step n2, which are converted to suitable data (corresponding parameters) which are input to the register array 20 of the sound source LSI 2 at a step n3.

FIG. 6B shows a routine executed when the CPU 3 has received the interrupt signal from the determining circuit 5. Upon receiving the interrupt signal, the CPU 3 delivers a WAIT signal to the PC 11, to thereby temporarily stop data transmission from the PC 11 at a step n6, and then switches the selector 4 to connection to the expansion bus 12 (connection to the PC 11) at a step n7, whereby the PC 11 can directly access the sound source LSI 2. After thus changing settings of the sound board 1, the WAIT signal is canceled at a step n8. Then, the reset signal input to the CPU 3 is changed into an "L" level, thereby inhibiting the operation of the CPU 3.

When the power of the PC 3 is turned on, the sound board 1 also undergoes initialization to be executed when the power of the sound board 1 is turned on. At this time, the selector 4 may be set to connection to the PC 11 to thereby set the PC 11 into an FM sound mode, or alternatively it may be set to connection to the CPU 3 to thereby set the CPU 3 into a PCM sound mode. When the FM sound mode is set upon turning-on of the power of the PC 11, it is preferred that the initialization processing of the sound board 1 automatically sets the selector 4 to connection to the PC 11.

What is claimed is:

1. A tone generating apparatus for connection to a control device that outputs selecting data for selecting one of a plurality of different tone signal-forming methods and control data for controlling of the selected tone signal-forming method, comprising:

a tone signal-generating block having a plurality of tone signal-forming circuits that respectively form tone signals in accordance with said plurality of different tone signal-forming methods based on said control data;

a determining block that detects said selecting data delivered from said control device and determines to which of said plurality of tone signal-forming circuits said control data delivered from said control device is to be supplied, depending upon a result of said detection; and a control data supply block that supplies said control data to a corresponding one of said plurality of tone signal-forming circuits of said tone signal-generating block, depending upon a result of said determination by said determining block.

2. A tone generating apparatus according to claim 1, including a conversion/control block that converts said control data delivered from said control device to converted control data, and wherein said control data supply block supplies said control data delivered from said control device or said converted control data to said corresponding one of said plurality of tone signal-forming circuits of said tone signal-generating block.

3. A tone generating apparatus according to claim 2, wherein said control data supply block includes a changeover block that selectively supplies said control data delivered from said control device or said converted control data delivered from said conversion/control block to said tone signal-generating block, depending upon a result of said determination by said determining block.

4. A tone generating apparatus according to claim 3, wherein said determining block delivers a reset signal to said conversion/control block when said determining block determines that said control data delivered from said control device is to be supplied to a predetermined one of said plurality of tone signal-forming circuits, which operates based on said converted control data delivered from said conversion/control block, said conversion/control block causing said changeover block to select said converted control data from said conversion/control block and supply said converted control data to said tone signal-forming block, in response to said reset signal from said determining block.

5. A tone generating apparatus according to claim 3, wherein said determining block receives a signal from said control device, said determining block delivering an interrupt signal to said conversion/control block when said determining block determines that said signal from said control device designates an address of a predetermined one of said plurality of tone signal-forming circuits, said conversion/control block causing said changeover block to select said control data from said control device and supply said control data to said tone signal-forming block, in response to said interrupt signal from said determining block.

6. A tone generating apparatus according to claim 4, including an interface block arranged between said control device and said conversion/control block, and wherein said determining block receives a signal from said control device, said determining block determining whether said signal from said control device designates an address of said interface block or said address of said predetermined one of said plurality of tone signal-forming circuits, said determining block causing said changeover block to select said control data from said control device or said converted control data from said conversion/control block, depending upon a result of said last mentioned determination by said determining block.

7. A tone generating apparatus according to claim 5, including an interface block arranged between said control device and said conversion/control block, and wherein said determining block receives a signal from said control device, said determining block determining whether said signal from said control device designates an address of said interface block or said address of said predetermined one of said plurality of tone signal-forming circuits, said determining block causing said changeover block to select said control data from said control device or said converted control data from said conversion/control block, depending upon a result of said last mentioned determination by said determining block.

8. A tone generating apparatus for connection to a bus of a personal computer, said tone generating apparatus being supplied with selecting data and control data via said bus from said personal computer to generate a tone signal, comprising:

a sound source LSI having an FM sound source block and a PCM sound source block;

an interface that receives control data for controlling said PCM sound source block from said bus;

a CPU connected to said interface for decoding said control data input via said interface;

a selector that selectively connects said sound source LSI to one of said bus and said CPU;

registers corresponding respectively to said FM sound source and said PCM sound source of said sound source LSI; and a changeover control block that receives said selecting data, for selecting one of said FM sound source block and said PCM sound source block, and operates under control of said CPU for causing said selector to connect said sound source LSI to said bus when one of said registers corresponding to said FM sound source block is accessed according to said selecting data supplied through said bus by said personal computer, and for causing said selector to connect said sound source LSI to said CPU when said interface is accessed according to said selecting data supplied through said bus by said personal computer.

* * * * *